US006394170B1

(12) United States Patent
Hsu

(10) Patent No.: US 6,394,170 B1
(45) Date of Patent: May 28, 2002

(54) OPERATING STRUCTURE FOR VERTICALLY COLLECTING/SHUTTING A BLIND

(75) Inventor: Pey-Son Hsu, Changhua (TW)

(73) Assignee: Chin Feng Blinds Ind. Co., Ltd. (TW)

( * ) Notice: Subject to any disclaimer, the term of this patent is extended or adjusted under 35 U.S.C. 154(b) by 0 days.

(21) Appl. No.: 09/765,648

(22) Filed: Jan. 22, 2001

(51) Int. Cl.[7] ..... E06B 9/30
(52) U.S. Cl. ..... 160/168.1 R
(58) Field of Search ..... 160/168.1 R, 173 R, 160/176.1 R, 178.1 R

(56) References Cited

U.S. PATENT DOCUMENTS

| | | | | | |
|---|---|---|---|---|---|
| 3,727,665 | A | * | 4/1973 | Debs | 160/168.1 R |
| 5,060,709 | A | * | 10/1991 | Simon | 160/168.1 R |
| 5,573,051 | A | * | 11/1996 | Judkins | 160/168.1 R |
| 6,179,035 | B1 | * | 1/2001 | Anderson | 160/168.1 R |
| 6,192,963 | B1 | * | 2/2001 | Chen | 160/168.1 R |

* cited by examiner

*Primary Examiner*—David M. Purol
(74) *Attorney, Agent, or Firm*—Bacon & Thomas, PLLC

(57) ABSTRACT

Operating structure for vertically collecting/shutting a blind, including several fixing bodies arranged in an upper beam. A slat-controlling seat is pivotally disposed on a center of top section of each fixing body. The slat-controlling seat via a shaft rod and an actuating body is connected with a rotary controlling rod disposed on outer side of the upper beam. A ladder cord is fixed on the slat-controlling seat. Multiple restricting cords are positioned between lateral main cords of the ladder cord at equal intervals for the slats to pass therethrough. The end section of the main cord is fixed on a base seat under the slats. An adjustment section is disposed on one side of front edge of the upper beam. Several pulling cords are disposed on the adjustment section. One end of each pulling cord is conducted along the interior of the upper beam to the slat-controlling seat. The pulling cords are back and forth interlacedly outward passed through the through holes of the upper beam. After passing through the through holes, the pulling cords are further back and forth interlacedly extended through one side of the slats and all fixed on the base seat.

2 Claims, 5 Drawing Sheets

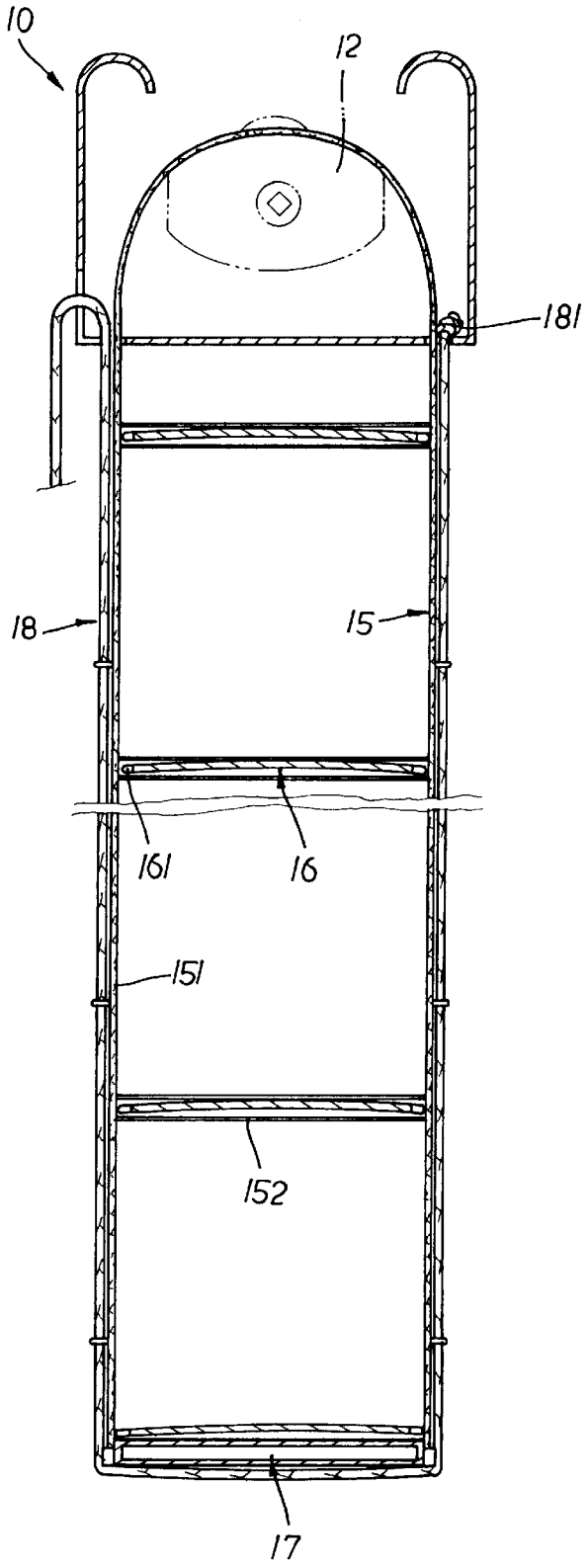
FIG·2 PRIOR ART

OPERATING STRUCTURE FOR VERTICALLY COLLECTING/SHUTTING A BLIND

BACKGROUND OF THE INVENTION

The present invention is related to an operating structure for vertically collecting/shutting a blind. The pulling cords of the operating structure are back and forth interlacedly arranged so that the total length of the pulling cord is shortened and the material cost for the pulling cord is reduced. In addition, when upward pulling and collecting the slats, the pulling length of the pulling cord is shorter so that the time for collection of the slats is reduced. Also, after collected, it is avoided that the pulling cord extends out from the upper beam by a very long length so that the appearance of the blind will not be affected and the pulling cord is not so liable to be hooked by an alien article.

FIGS. 1 and 2 show a conventional blind. A fixing seat 11 is mounted on a rack 10. A slat-controlling element 12 is pivotally disposed on the center of the top of the fixing seat 11. The slat-controlling element 12 is driven by a controlling shaft 13 which is driven by a rod body 14 controlled by a user. A pulling ladder cord 15 is fixed with the slat-controlling element 12. The pulling ladder cord 15 has two lateral main cords 151 and multiple restricting cords 152 positioned between the main cords 151. Slats 16 are passed through the spaces between the restricting cords 152. The bottom of the main cord 151 is fixed on a base seat 17. The slat 16 is formed with a locating notch 161 corresponding to the main cord 151. Several hanging cords 18 are further disposed beside the main cord 151 for hanging and pulling the entire body. The hanging cord 18 has a fixed end 181 fixed with one side of the fixing seat 11. The hanging cord 18 is then wound through the respective slats 16 and the base seat 17 and passed through the fixing seat 11 into the rack 10. The other end of the hanging cord 18 serves as a pulling end 182 for a user to pull.

The above conventional structure has some shortcomings as follows:

1. The hanging cord 18 is conducted and wound on two lateral ends of the slats 16 and the base seat 17. Accordingly, the hanging cord 18 must have a considerable length so that the cost for the material will be increased.
2. The hanging cord 18 has a very long length so that when pulled upward to collect the slats, it takes much time to pull the hanging cord 18.
3. After pulled upward to collect the slats, the very long hanging cord 18 will extend out from the rack 10 by a very long length (with reference to FIG. 3). The extending hanging cord 18 will affect the appearance of the blind and is liable to be hooked by an alien article. Therefore, the safety in use of the blind cannot be ensured.

SUMMARY OF THE INVENTION

It is therefore a primary object of the present invention to provide an operating structure for vertically collecting/shutting a blind. The pulling cords of the operating structure are respectively back and forth interlacedly extended and fixed on one side of the base seat. Therefore, the total length of the pulling cord is shortened and the material cost for the pulling cord is reduced.

It is a further object of the present invention to provide the above operating structure in which the pulling cords are back and forth interlacedly arranged with a certain length. Therefore, when upward pulling and collecting the slats, the pulling length of the pulling cord is shorter so that the time for collection of the slats is reduced.

It is still a further object of the present invention to provide the above operating structure in which the pulling cord has a suitable length. Therefore, after pulled upward to collect the slats, it is avoided that the pulling cord extends out from the upper beam by a very long length. Therefore, the appearance of the blind will not be affected and the pulling cord is not so liable to be hooked by an alien article.

The present invention can be best understood through the following description and accompanying drawings wherein:

BRIEF DESCRIPTION OF THE DRAWINGS

FIG. 2 is a side sectional view of the conventional blind;

DETAILED DESCRIPTION OF THE PREFERRED EMBODIMENT

Figure 4:
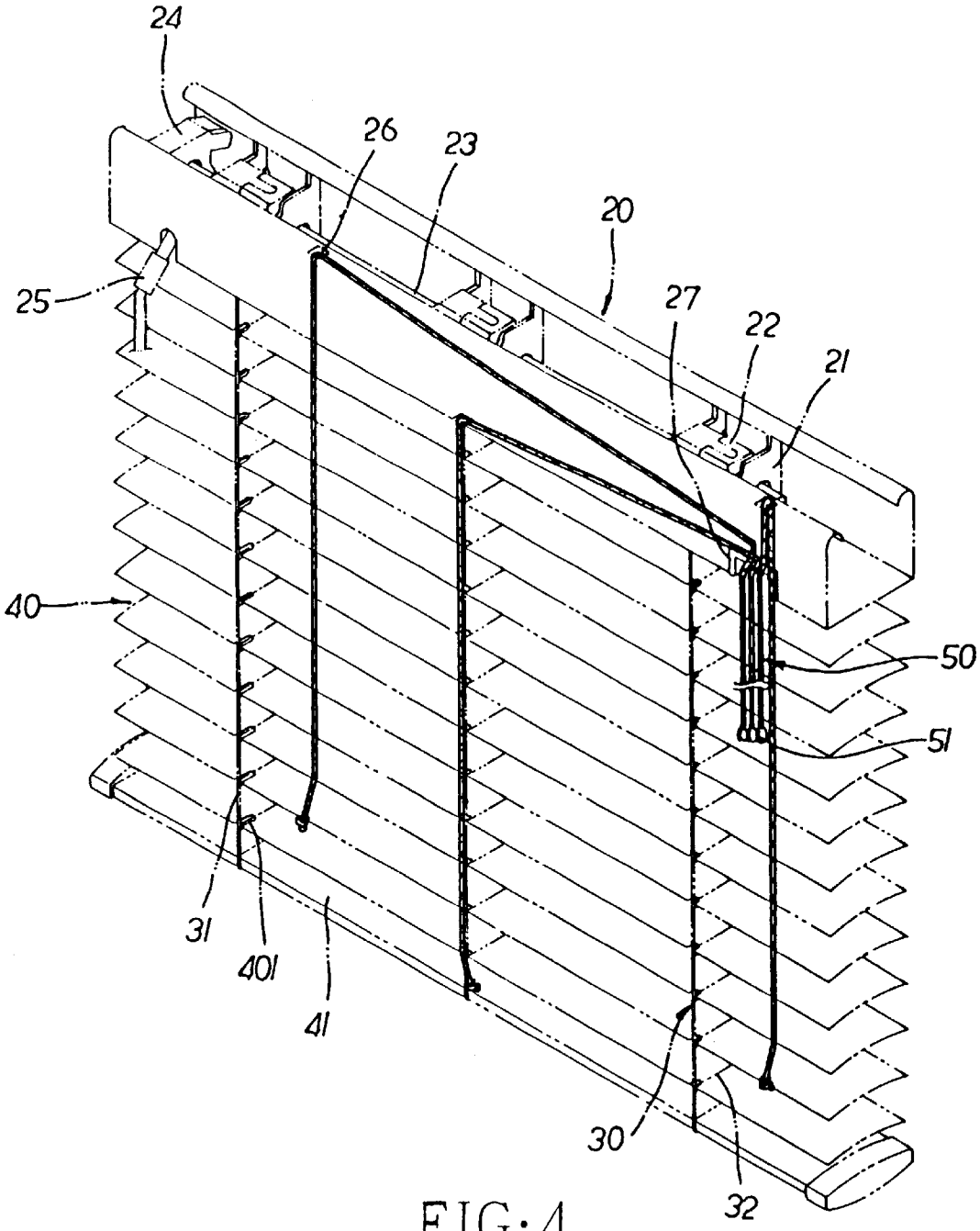
FIG. 4 is a perspective view of the blind of the present invention.
Figure 5:
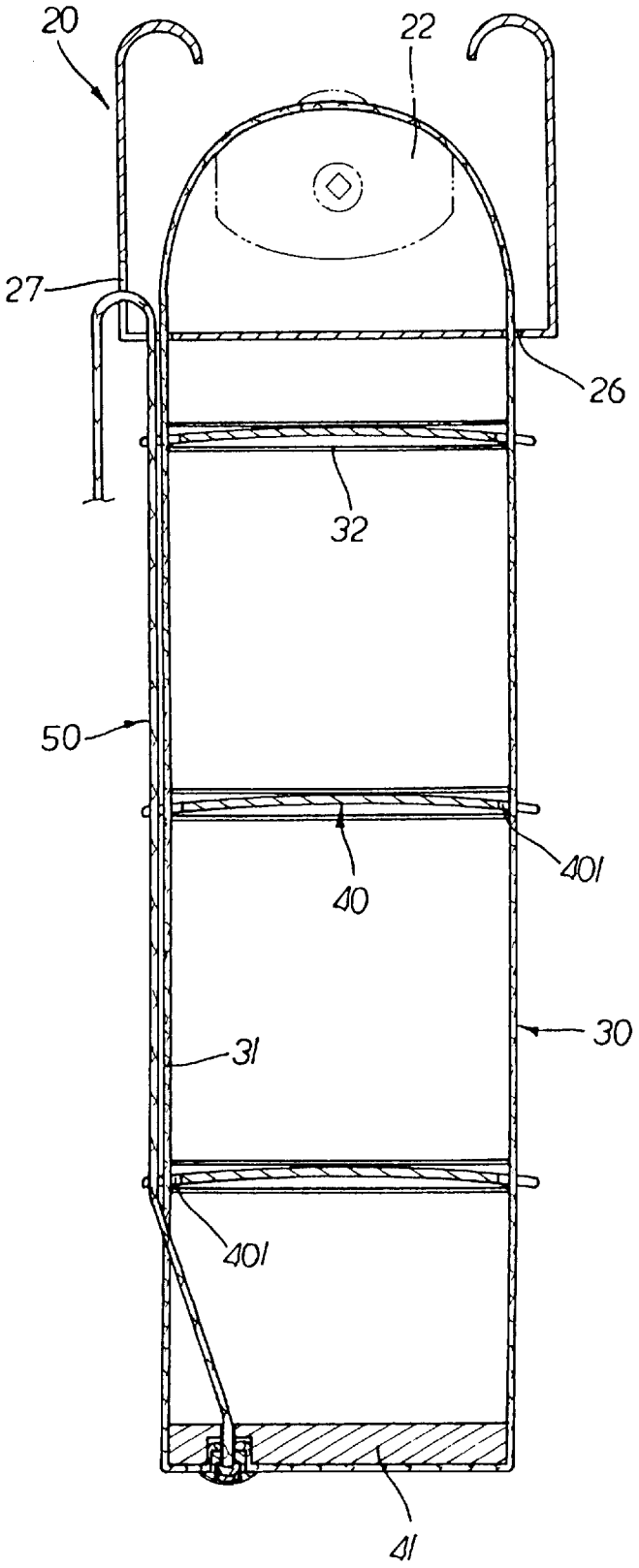
FIG. 5 is a side sectional view of the blind of the present invention.

Please refer to FIGS. 4 and 5. Several fixing bodies 21 are arranged in an upper beam 20 at equal intervals. A slat-controlling seat 22 is pivotally disposed on the center of the top of each fixing body 21. The slat-controlling seat 22 via a shaft rod 23 and an actuating body 24 is connected with a rotary controlling rod 25 disposed on outer side of the upper beam 20. By means of rotating the rotary controlling rod 25, the actuating body 24 can drive the shaft rod 23 and the slat-controlling seat 22 to move. A ladder cord 30 is fixed on the slat-controlling seat 22. The ladder cord 30 extends outward through the through holes 26 of front and rear sides of the bottom of the upper beam 20 to lower side of the upper beam 20. Multiple restricting cords 32 are positioned between the lateral main cords 31 of the ladder cord 30 at equal intervals. The slats 40 of the blind are passed through the spaces between the restricting cords 32. The end section of the main cord 31 is fixed on a base seat 41 under the slats 40. The edges of the slats 40 are formed with a locating notch 401 corresponding to the main cord 31 of the ladder cord 30 for receiving the main cord 31 therein and preventing the slats 40 from deflecting when put down or pulled up. An adjustment section 27 is disposed on one side of front edge of the upper beam 20. Several pulling cords 50 are disposed on the adjustment section 27. One end of each pulling cord 50 is conducted along the interior of the upper beam 20 to the slat-controlling seat 22. The pulling cords 50 are back and forth interlacedly passed through the through holes 26 of the upper beam 20. After passing through the through holes 26, the pulling cords 50 are further back and forth interlacedly extended through one side of the slats 40. The pulling cords 50 are all fixed on the base seat 41. The other end of the pulling cord 50 is directly conducted out of the adjustment section 27 to serve as a pulling section 51.

As shown in FIG. 4, the adjustment section 27 can be L-shaped.

Figure 1:
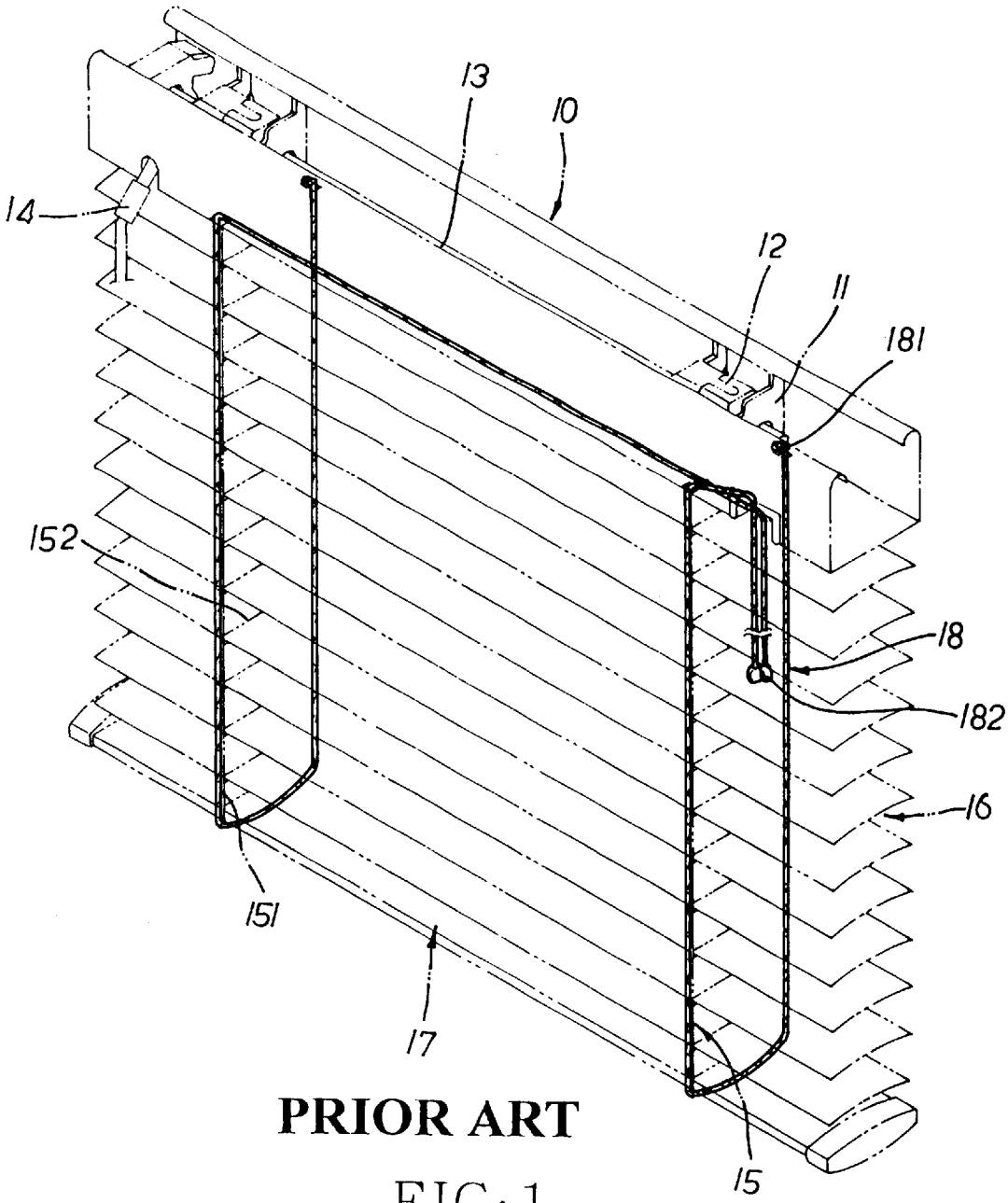
PRIOR ART FIG·1
FIG. 1 is a perspective view of a conventional blind.
Figure 6:
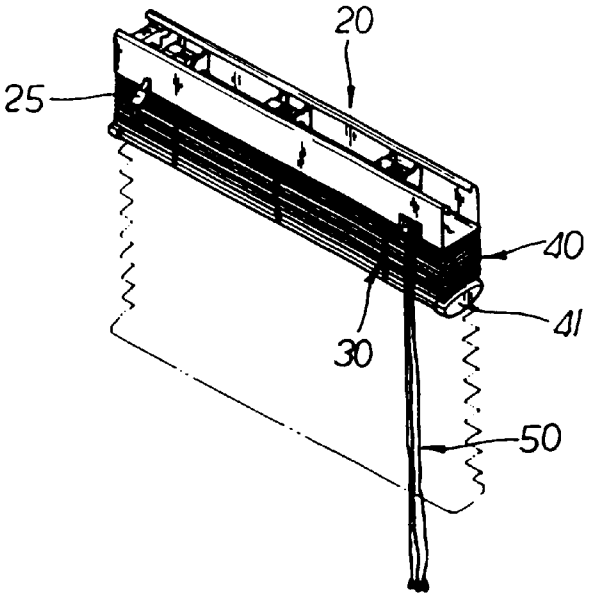
FIG. 6 shows the blind of the present invention in a collected state.
Figure 3:
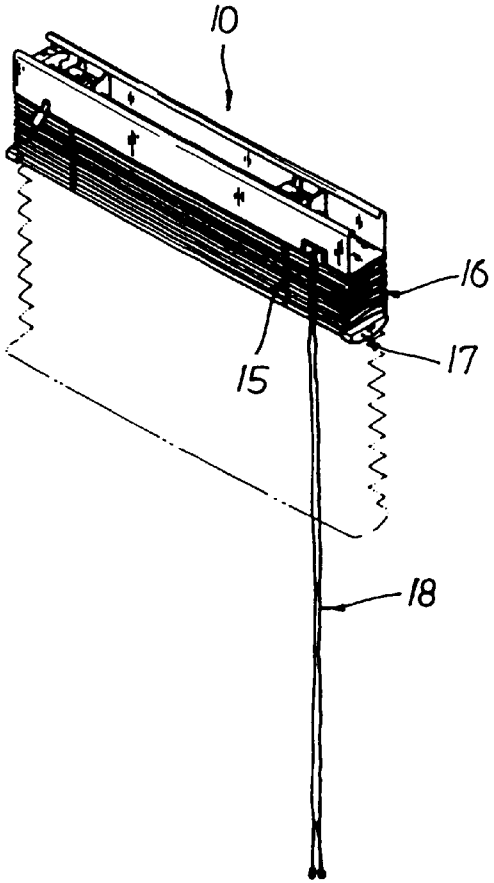
FIG·3 PRIOR ART
FIG. 3 shows the conventional blind in a collected state.

When upward pulling and collecting the slats, as shown in FIG. 6, a user only needs to pull the pulling section 51 of the pulling cord 50 toward one side so as to temporarily disengage the pulling cord 50 from the adjustment section 27 of the upper beam 20. Then the pulling cord 50 is pulled downward, whereby the slats 40 are driven by the lowermost base seat 41 to be parallelly and synchronously moved upward and collected. After the slats 40 are collected at a certain height, the pulling cord 50 is released to again engage with the adjustment section 27. At this time, the slats 40 and the base seat 41 are located by the adjustment section 27 without dropping down. When putting down and shutting the blind, the pulling section 51 of the pulling cord 50 is pulled toward one side so as to temporarily disengage the pulling cord 50 from the adjustment section 27. Then the pulling cord 50 is released to easily make the slats 40 move down.

According to the above arrangement, the present invention has the following advantages:

1. The pulling cords 50 are respectively back and forth interlacedly extended and fixed on one side of the base seat 41. Therefore, the total length of the pulling cord 50 is shortened and the material cost for the pulling cord 50 is reduced.
2. The pulling cords 50 are back and forth interlacedly arranged with a certain length. Therefore, when upward pulling and collecting the slats, the pulling length of the pulling cord 50 is shorter so that the time for collection of the slats is reduced.
3. The pulling cord 50 has a suitable length. Therefore, after pulled upward to collect the slats, it is avoided that the pulling cord 50 extends out from the upper beam 20 by a very long length (with reference to FIG. 6). Therefore, the appearance of the blind will not be affected and the pulling cord 50 is not so liable to be hooked by an alien article.

The above embodiment is only used to illustrate the present invention, not intended to limit the scope thereof. Many modifications of the above embodiment can be made without departing from the spirit of the present invention.

What is claimed is:

1. A blind comprising:

a slat-controlling seat;

a plurality of fixing bodies configured to receive the slat-controlling seat that is rotatable along its longitudinal axis;

an upper beam housing the fixing bodies, the upper beam including a plurality of through holes;

an actuating body connected to the slat-controlling seat;

a rotary controlling rod in connection with the actuating body such that when the rotary controlling rod is rotated, the actuating body causes the slat-controlling seat to rotate along its longitudinal axis;

a base seat;

a plurality of ladder cords, each of the ladder cords comprising a main cord that is hung over the slat-controlling seat and secured around the base seat, the ladder cords extend into and out of the through holes of the upper beam, each of the ladder cords further comprises multiple pairs of restricting cords that each house a slat therebetween, the slats extend to adjacent pairs of the restricting cords of adjacent ones of the ladder cords, the main cords are secured between the slat-controlling seat and the base seat; and wherein the improvement comprises an adjacent section positioned at the upper beam, a plurality of pulling cords each secured to the base seat and detachably secured to the adjustment section such that when the pulling cords are detached from the adjustment section, the pulling cords can be pulled to raise the base seat towards the upper beam or released to lower the base seat away from the upper beam.

2. The blind as claimed in claim 1, wherein the adjustment device is L-shaped.

* * * * *

UNITED STATES PATENT AND TRADEMARK OFFICE

CERTIFICATE OF CORRECTION

PATENT NO. : 6,394,170 B1
DATED : May 28, 2002
INVENTOR(S) : Pey-Son Hsu

It is certified that error appears in the above-identified patent and that said Letters Patent is hereby corrected as shown below:

Title page,
Item [73], change "Chin Feng Blinds Ind. Co., Ltd. (TW)" to
-- Ching Feng Blinds Ind. Co., Ltd. (TW) --

Signed and Sealed this

Eighth Day of April, 2003

JAMES E. ROGAN
*Director of the United States Patent and Trademark Office*